United States Patent [19]

Thuillier et al.

[11] 4,412,095

[45] Oct. 25, 1983

[54] ELECTRIC INSULATOR OF THE LINE POST TYPE

[75] Inventors: Denis Thuillier, Vichy; Michel Willem, Abrest, both of France

[73] Assignee: Societe Anonyme dite: CERAVER, Paris, France

[21] Appl. No.: 347,198

[22] Filed: Feb. 9, 1982

[30] Foreign Application Priority Data

Feb. 13, 1981 [FR] France ..... 81 02888

[51] Int. Cl.[3] ..... H01B 17/16

[52] U.S. Cl. ..... 174/158 R; 174/177

[58] Field of Search ..... 174/140 S, 158 R, 163 R, 174/168, 169, 176, 177, 178, 179, 186, 188, 194, 209; 403/300, 309, 310, 311, 312

[56] References Cited

U.S. PATENT DOCUMENTS 3,534,989 10/1970 Yonkers ..... 174/176 X 3,877,523 4/1975 Ely ..... 174/177 X 3,898,372 8/1975 Kalb ..... 174/179

FOREIGN PATENT DOCUMENTS 826546 1/1938 France .

*Primary Examiner*—Laramie E. Askin

*Attorney, Agent, or Firm*—Kenyon & Kenyon

[57] ABSTRACT

The invention relates to an electric insulator of the line post type which has a rod (2) made of glass fibres agglomerated in resin and covered with a protective elastomer sheath. A socket (15) with an opening (16) is provided to make it fast with post (14). The socket end of the rod is machined to provide a hollow (8) designed to improve the mechanical characteristics of the rod in the fitting (1) of the post (14). A locking piece (17), which is complementary to the hollow (8) in the rod (2), clamps the assembly together by means of two fixing parts (18).

6 Claims, 5 Drawing Figures

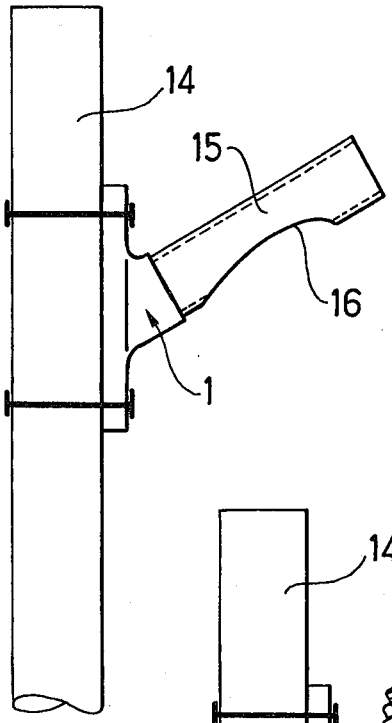
FIG. 3
FIG. 4
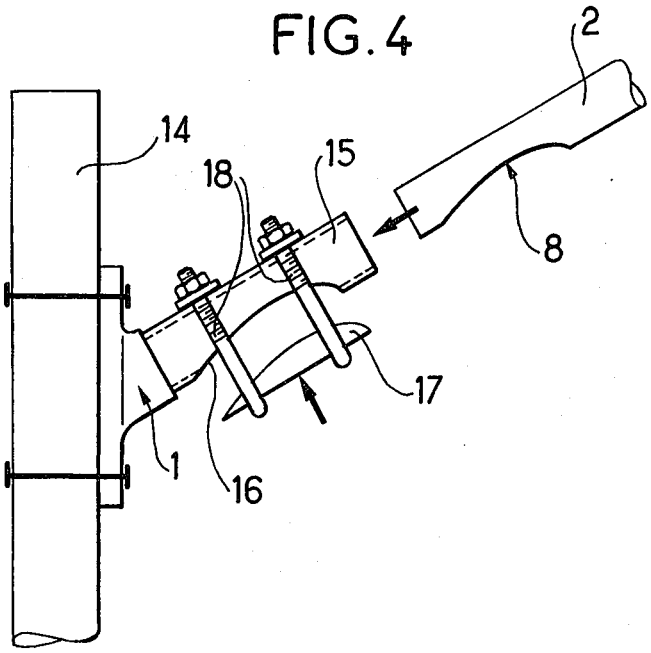
FIG. 5
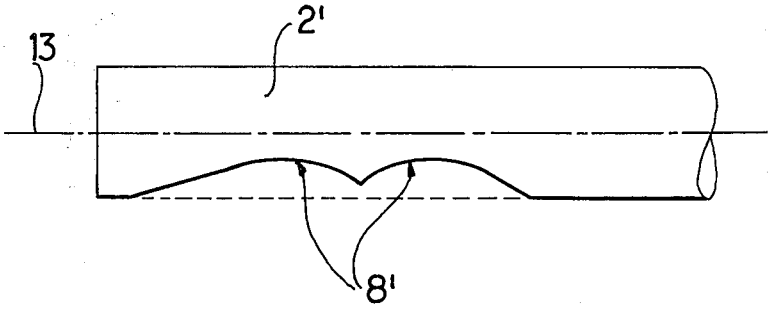

ELECTRIC INSULATOR OF THE LINE POST TYPE

The present invention relates to an electric insulator of the line post type and in particular to anchoring the insulator on a post.

BACKGROUND OF THE INVENTION

In outline, such an insulator consists of a rod made of resin and glass fibre covered with an elastomer sheath which may be fitted with fins also made of an elastomer e.g. EPDM (Ethylene-Propylene-Diene Monomer). One of its ends is fixed to a post by means of a fitting and the other end has another fitting to which a clip for a conductor is attached.

The rod as a whole and in particular its end which is anchored in the fitting fixed to the post is subject to great mechanical stress. It tends to sag under the weight of the conductor; the upper fibres are subject to a traction force while the lower fibres are subject to a compression force.

To improve the anchoring of the end of the rod, it has already been proposed to machine said end so as to impart a cone or double cone shape thereto; however, under the effect of high mechanical loading it has been observed that cracks appear between the fibres parallel to the direction thereof.

Preferred embodiments of the present invention mitigate this drawback and provide an insulator of the line post type which has anchoring means at its end nearest to the post conferring improved mechanical strength to the rod.

SUMMARY OF THE INVENTION

The present invention provides an electric insulator of the line post type which as a rod made of resin and glass fibres covered with an insulating sheath, one end of the insulator being made fast with a fitting intended to be fixed on a post, in which insulator the wall of said one end has at least one hollow orthogonal to the direction of the fibres and situated in the zone where the fibres are liable to be subject to high compression stress, the depth of the hollow not reaching the neutral fibres of the rod, the end of the rod thus machined being held motionless in a cylindrical socket of said fitting which socket is open adjacent said hollow to accommodate a complementary locking piece which fills said hollow.

The surface of the rod may have two successive hollows for example. In all cases, said surface is entirely protected by a sealed sheath made of an elastomer such as EPDM.

According to a particularly advantageous embodiment, said hollow is a cylinder whose generating lines are perpendicular to the axis of the rod and whose director curve has a slope of about 10% from the end of the rod followed by an arc of a circle which is itself followed by a curve whose slope is close to 20%.

The fitting and the complementary locking part may be made fast to each other by fixing parts or even by welding.

BRIEF DESCRIPTION OF THE DRAWINGS

Embodiments of the invention are drecribed by way of example with reference to the accompanying drawings in which:

FIGS. 3 and 4 are diagrammatic elevations showing an end fitting associated with a pylon and the insertion of the rod in its socket; and FIG. 5 illustrates a variant of the machined rod.

MORE DETAILED DESCRIPTION

Figure 1:
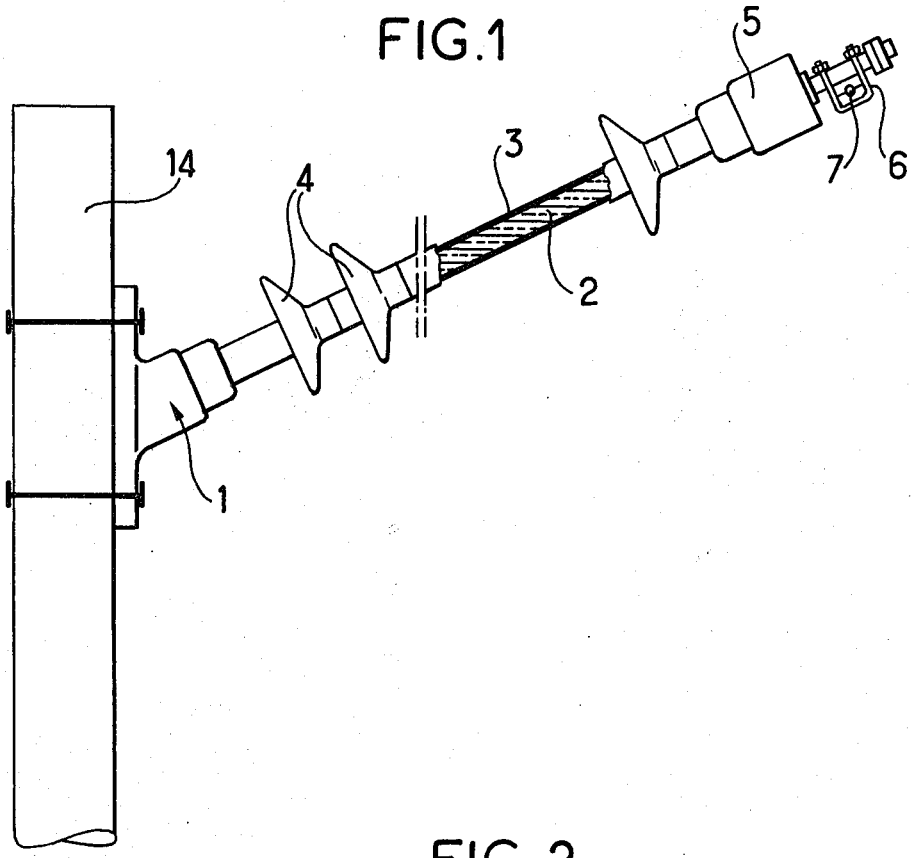
FIG. 1 is a partially cutaway diagrammatic view of an insulator of the line post type.

The insulator shown in FIG. 1 is fixed on a post 14 by means of a fitting 1. The insulator comprises a rod 2 made of resin and glass fibres covered with an elastomer sheath 3 on which fins 4 also made of elastomer are installed. A fitting 5 is fixed on the other end of the rod 2 with a clip 6 for attaching a conductor 7 thereto.

Figure 2:
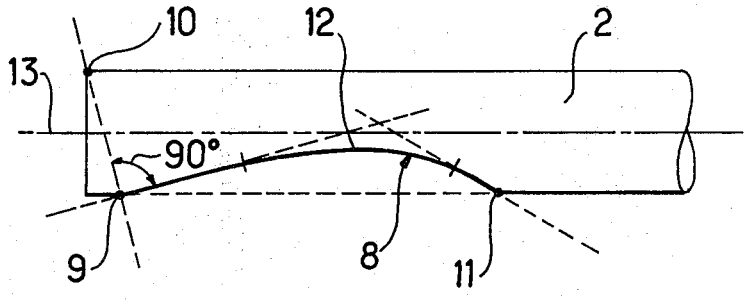
FIG. 2 is a diagrammatic illustration of a machined rod in accordance with the present invention.

In the neighbourhood of the fitting 1, the rod has the shape illustrated in FIG. 2.

The shape of the machined rod results from the intersection of the cylinder formed by the rod itself and by an incident imaginary cylinder whose generating lines are horizontal and perpendicular to the axis of the rod. The term "cylinder" is taken in its most general meaning and is therefore not limited to a body of circular crosssection. The intersection of the surface of said incident cylinder with the vertical plane which passes through the axis 13 of the rod 2 forms a director curve 8 whose normal at one end 9 preferably passes through the highest point 10 of the end of the rod 2.

It is advantageous for the slope of the curve 8 from the aforementioned end to be about 10% and to be about 20% at its other end 11; these two slopes are connected together by an arc 12 which always remains situated below the neutral fibres.

As seen in FIGS. 3 and 4, the shaped end of the rod 2 is fitted into a cylindrical socket 15 designed to be made fast with the fitting 1. Said fitting 15 has an opening 16 whose profile matches that of a hollow 8 in the rod 2 and is intended to accommodate a complementary locking piece 17 which fills the hollow 8. The assembly thus formed is held in place by means of two fixing parts 18.

The rod 2 can advantageously have two successive hollows 8' (see FIG. 5) of the same shape as that previously described instead of the single hollow illustrated in FIG. 2. The hollows in the rod 2' can then be shallower and therefore remain further from the neutral fibres.

Preferably, the entire surface of the rod is covered with an insulating elastomer sheath. Therefore, the hollow 8 is lined with an elastomer sheet which is sealed thereabout by glueing or welding to the sheath 3 or to the fins 4.

In the previously described examples, it is seen that when the line post is subjected to high mechanical forces due to the presence of a cable 7:

- the upper fibres of the rod which are subjected to tractive stress are not affected by the hollow being machined in the rod;
- the lower fibres which are subjected to compression stress have been machined but they bear against the complementary locking piece: therefore machining is not a disadvantage;
- the fact that the rod has a hollow filled by the locking piece imposes a transversal compression force on the rod. This force is initially moderate but increases with the load imposed on the insulator. Now, this transversal compression force reduces the risk of the stretched fibres coming apart from the compressed fibres of the rod. Mechanical strength is therefore increased.

Of course, the invention is not limited to the embodiments described herein, without going beyond the scope of the invention, any means can be replaced by equivalent means.

We claim:

1. An electric insulator of the line post type which has a rod made of resin and glass fibres covered with an insulating sheath, one end of the rod being made fast with a fitting intended to be fixed on a post, in which rod the wall of said one end has at least one hollow orthogonal to the direction of the fibres and situated in the zone where the fibres are liable to be subject to high compression stress, the depth of the hollow not reaching the neutral fibres of the rod, the end of the rod having said hollow being held motionless in a cylindrical socket of said fitting which socket is open adjacent said hollow and accommodates a complementary locking piece which fills said hollow.

2. An insulator according to claim 1, wherein said hollow is a cylinder whose generating lines are perpendicular to the axis of the rod and whose director curve has a slope of about 10% from the end of the rod followed by an arc of a circle which is itself followed by a curve whose slope is close to 20%.

3. An insulator according to claim 1, wherein the surface of the rod has two successive hollows.

4. An insulator according to claim 1, wherein said fitting and said complementary locking piece are held fast together by two fixing parts.

5. An insulator according to claim 1, wherein said fitting and said complementary locking piece are held fast together by welding.

6. An insulator according to any one of the preceding claims, wherein the entire surface of said rod is protected by said insulating sheath even over said hollow.

* * * * *